US011571037B2

(12) United States Patent
Kyle

(10) Patent No.: US 11,571,037 B2
(45) Date of Patent: Feb. 7, 2023

(54) BIMODAL HEEL COUNTER AND DEPENDENT FASTENING ELEMENTS FOR RAPID ENTRY AND RELEASE FOOTWEAR DEVICES

(71) Applicant: Kentigern S. Kyle, Naples, FL (US)

(72) Inventor: Kentigern S. Kyle, Naples, FL (US)

( * ) Notice: Subject to any disclaimer, the term of this patent is extended or adjusted under 35 U.S.C. 154(b) by 0 days.

(21) Appl. No.: 17/146,100

(22) Filed: Jan. 11, 2021

(65) Prior Publication Data

US 2021/0145114 A1 May 20, 2021

Related U.S. Application Data

(63) Continuation-in-part of application No. 16/120,899, filed on Sep. 4, 2018, now Pat. No. 11,000,091.

(60) Provisional application No. 62/694,484, filed on Jul. 6, 2018, provisional application No. 62/553,326, filed on Sep. 1, 2017.

(51) Int. Cl.

| | |
|---|---|
| ***A43B 11/00*** | (2006.01) |
| ***A43C 11/14*** | (2006.01) |
| ***A43B 23/08*** | (2006.01) |

(52) U.S. Cl.

CPC ..... *A43B 11/00* (2013.01); *A43B 23/088* (2013.01); *A43C 11/14* (2013.01)

(58) Field of Classification Search

CPC ..... A43B 11/00; A43B 11/02; A43B 23/088

See application file for complete search history.

(56) References Cited

U.S. PATENT DOCUMENTS

| | | | | |
|---|---|---|---|---|
| 3,039,207 | A * | 6/1962 | Lincors | A43B 13/18 36/58.5 |
| 5,481,814 | A * | 1/1996 | Spencer | A43B 7/00 36/103 |
| 8,225,534 | B2 * | 7/2012 | Mueller | A43B 13/16 36/76 R |
| 10,602,802 | B2 * | 3/2020 | Hopkins | A43B 13/141 |
| 10,660,401 | B1 * | 5/2020 | Pratt | A43B 13/14 |
| 2014/0298687 | A1 * | 10/2014 | Flinterman | A43B 13/14 36/103 |
| 2016/0058123 | A1 * | 3/2016 | Peyton | A43B 13/183 36/25 R |
| 2018/0235314 | A1 * | 8/2018 | Farage | A43B 23/0245 |
| 2018/0263332 | A1 * | 9/2018 | Bruno | A43B 13/188 |

* cited by examiner

*Primary Examiner* — Ted Kavanaugh

(57) ABSTRACT

A bimodal heel counter apt for a rapid entry and release footwear devices, that includes a flexible hollow hemisphere portion, a heel tab, a secondary heel tab, a back sole base, an anchor system, and dependent fastening elements. The bimodal heel counter and dependent fastening systems are biased to one of two stable positions, which elastically morphs by stored potential energy with applied force from one position to the other, configured to collectively snap a footwear device between an open and closed position, for donning and doffing, or securing the foot as to enable active footwear use.

19 Claims, 11 Drawing Sheets

BIMODAL HEEL COUNTER AND DEPENDENT FASTENING ELEMENTS FOR RAPID ENTRY AND RELEASE FOOTWEAR DEVICES

CROSS-REFERENCE TO RELATED APPLICATIONS

This application is a continuation-in-part of parent U.S. Nonprovisional patent application Ser. No. 16/120,899, filed Sep. 4, 2018, and claims the benefit of U.S. Provisional Patent Application Ser. No. 62/694,484, filed Jul. 6, 2018 and U.S. Provisional Patent Application Ser. No. 62/553,326, filed Sep. 1, 2017, which are incorporated herein in their entirety.

FIELD OF THE INVENTION

The present disclosure is generally directed to footwear, and more particularly to a bimodal heel counter device and related fastening systems apt to engender functional bimodal shoes, or other foot related mechanical devices.

BACKGROUND OF THE INVENTION

It is common for individuals to wear shoes or shoe-like devices for protection, comfort, or in conjunction with a foot related device. A shoe usually has a fastening arrangement that allows a user to fasten their shoe to their foot. For example, such fastening arrangements may include straps, shoe laces, zippers, loop-and-strap, buckles, and others. However, existing shoes are problematic because their fastening is complicated, takes time, requires use of the inconvenient use of hands, or they do not provide sufficient support to portions of the foot for full mobility and a range of activities.

Therefore, there exists a need for an improved shoe that is quick and easy to don and doff, with minimal use of hands, and has a clearly disclosed, defined and functional bimodal system as to enable a person skilled in the art to replicate and manufacture.

SUMMARY OF THE INVENTION

Disclosed herein, according to various embodiments, is a bimodal heel counter device suitable for various rapid entry and release footwear devices, composed of some or all of a flexible, hollow hemisphere portion, a heel tab, a secondary heel tab, a back sole base, an anchor system, and dependent fastening elements that are integrated into the footwear device. The bimodal heel counter and related fastening elements are configured to selectively snap between an open and closed position, providing an opening of the footwear while in the open position, at which the footwear is apt for donning and doffing, and in another instance providing tight securement to the back ankle and, or, the midfoot and forward area of the hindfoot while in the closed position, during which the footwear is apt for active use.

This summary is provided to introduce a selection of concepts in a simplified form that are further described below in the detailed description. This summary is not intended to identify all key features or essential features of the claimed subject matter, nor is it intended to be used to limit the scope of the claimed subject matter. The invention as disclosed incorporates a multitude of concepts that some or all of which can combine to collectively solve the challenges as defined. These concepts and related features and elements as well as the operation of the disclosed embodiments will become more apparent in light of the following description of various embodiments and accompanying drawings.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DESCRIPTION

Figure 1:
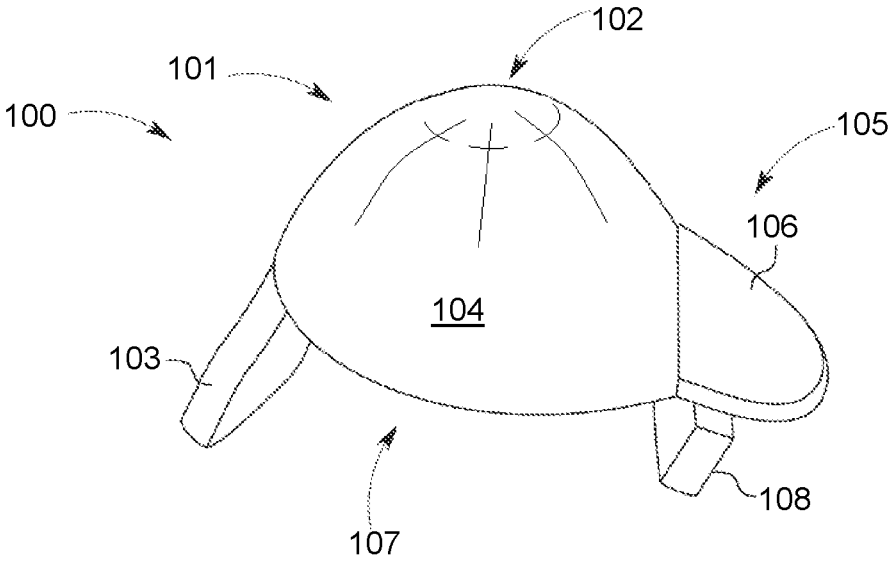
FIG. 1 is a schematic illustration in forward perspective view of a bimodal heel counter device for an article of footwear in a stable, convex position.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the bimodal heel counter as oriented in FIG. 1, and the general location of fastening elements on an article of footwear in which the heel is located at the rear portion, the toe hold is to the front, the top is to higher elevated portions of the upper, and the sole is at the lower section, regardless of perspective. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Disclosed is a bimodal heel counter device with dependent fastening elements that are implemented in a variety of footwear design embodiments, defined as a shoe device or other similar foot device that can incorporate the benefits of the devices defined in the present teachings, including but not restricted to footwear devices as found with shoes, boots, sandals, clogs, skis, snowboards, skates, skateboards, aquatic flippers, jet ski foot securement areas, paddle boards foot securement areas, bicycle foot enclosing devices, or other similar footwear with heel counters that require fastening and release of a foot, herein and hereafter referred to as "footwear device" or "article of footwear" or "shoe."

A shoe fastening device comprises a bimodal heel counter with dependent fastening elements that are connected to other elements of an article of footwear including a sole, that can reference portions of a midsole, outsole, or insole, underlying the bimodal heel counter, and an upper defining at least some of a foot cavity with collar to insert a foot, heel notch, bridge, tongue, quarter, a front foot strap, comprising one or more of the shoe box, vamp, or toe loop, and side walls. The bimodal heel counter is centered and placed or formed with the sole as to be positioned below the rear of the heel. Subsequent embodiments are hereafter described that contain dependent fastening elements that are dependent and move with the bimodal heel counter, and are utilized in various combinations as to create alternative embodiments of articles of footwear, all using a fastening system based on a morphable bimodal heel counter.

The stable states of the bimodal heel counter in conjunction with related fasteners enable hands-free ingress and egress, by changing areas of a footwear device from an open position apt for placing or removing a foot with a large receiving cavity, to a closed position, with related fasteners encircling portions of the foot as to provide a secure fit. The bimodal heel counter along with related fastening systems facilitate hands-free, ingress and egress of a shoe, i.e. securement of a shoe without the use of hands or fingers, whereas in the stable convex position of the bimodal heel counter the user is presented with an elevated and angled foot insertion cavity, whereas upon sliding the foot into the cavity and subsequent downward force by the heel of the entering foot, the bimodal heel counter will morph to its stable concave position, with related fastening systems securing various portions of the foot and lowering the foot insertion cavity. To return to the open position of the shoe apt for donning or doffing, downward force is supplied by the opposite heel or other manual means, the bimodal heel counter thus morphing back to its stable convex position, releasing or tightening dependent fastening elements from portions of the foot and raising the foot insertion cavity.

In one aspect of the device, the bimodal heel counter fastening system is comprised of a main body of flexible material shaped similar to a hollow hemispherical form, an extended back heel tab, a secondary heel tab, an anchoring system, a complementing base, and dependent fastening elements including a shoe collar strap, side heel straps, rear heel strap, a secondary heel tab, and other straps, bands, belts, wall, buckles, loops, and other connectors or vector changing elements incorporated into other portions of a shoe device.

In another aspect of the device, the hollow hemispherical form and spherical radii are sized as to have the hollow cavity the approximate size of the rear portion of the end user's heel. The hollow hemisphere form comprises the filled-in void between dual concentric hemispheres sharing a horizontal plane of circular circumferences but with different radius and related scaling, as to form a single hollow hemisphere solid form ranging in thickness from approximately 3 mm to 6 mm with a circumferential, flat lip with the same width, being the difference of radii of the dual concentric hemispheres. The hemispherical face may be a range of scalings, half ellipsoids of various sizing, or may include slits, spaces, or gaps, while still preserving the known mechanical properties of a hollow hemisphere of flexible material. In other aspects of the device, the hollow hemisphere form may include a single dimple located roughly at the vertical midpoint of the rear face of the convex state. In other aspects the hollow hemisphere form is morphed to a shape approaching that of a distended cone with a rounded apex while in its convex state, or other deformations and scaling as to improve bimodal functionality, morphing capability and end shape, depending on the specific foot and shoe requirements, with this slight cone-like feature positioned as to best contact the downward placed heal, depending on the design of the shoe. The hollow hemispherical form utilizes the tensile properties of materials similar in nature to plastics, sheet metals, urethane and silicone rubbers, natural rubber, or Ethylene Vinyl Acetate, wherein the portions or entirety of the hollow hemispherical form can be changed from convex to concave position by directional force from different sides and directions. In the preferred embodiment, the bimodal heel counter is manufactured in the native convex position and assembled and connected to dependent fastening elements in inverted concave position.

In another aspect of the device, the hollow hemisphere of the bimodal heel counter is convex.

In another aspect of the device, the hollow hemisphere of the bimodal heel counter is concave.

In another aspect of the device, joined to the rearward face just above the circumferential lip is a back heel tab in the general shape of a flattened rectangular prism, of similar thickness, and general width similar to, the radius of the internal hemisphere, projecting generally downward at a 45 degree angle relative to the plane of the circumferential lip, with the bimodal heel counter in its convex form, as to provide a surface that portions of the opposing foot can contact. The heel tab is constructed of a length as similar or greater than the width.

In another aspect of the device, joined to the forward base of the back heel tab, is a secondary heel tab also in the general shape of a flattened rectangular prism, of approximately half the thickness and width of the back heel tab, projecting horizontal and rearward, relative to the sole, with a difference in angle of approximately thirty five degrees from the downward back heel tab while the hollow hemisphere is in the convex position, and manufactured so as to be provide a surface that other straps or dependent fastening elements can be attached using a grommet, button, glue or other securing system. The length of the secondary heel tab is determined by the size of the end user's foot, designed to reach similar height as the lower portion of the Achilles tendon when the hollow hemisphere is in the concave position, and permitting the heel tab to be pulled back without applying significant force to the heel notch at the onset of the bimodal morph of the hollow hemisphere form. The length, thickness, shape and material are similarly designed so as that when the bimodal heel counter is in its convex position, the heel notch and, or, connected side bands are both pulled slightly to the rear of the shoe, at a position to the rear of the horizontal, convex hemisphere, spaced sufficiently for the heel of the user to come down upon the hemisphere without comprising the heel notch or straps.

In another aspect of the device, the bimodal heel counter has a lower structure opposite from the heel tab, adjoined to the front portion of the circumferential lip, or in some cases, joined to a portion of the hemisphere face directly adjacent to front portion of the circumferential lip, that can be fastened to the sole, forming an anchor system. The anchor system is fastened to or integrated with the sole typically in the medial section of the sole as to position the hemisphere portion of the bimodal heel counter with a hollowed portion facing forward when in a concave position, and with a hollowed portion facing downward when in a convex position. The anchor system is comprised of a flat lateral tab fastened to a sole, a cylindrical(s), square(s), rectangle(s) or other shaped block(s) that is or are connected to the forward lip of the hemisphere and embedded in the insole, midsole, outsole or general sole, or manufactured in one piece along with the insole, midsole, outsole, or sole depending on the design of the footwear device, integrated into added elements of the insert or inner support as create a generally flat plane apt for a foot to rest upon with the article of footwear in either bimodal position.

In another aspect of the device, there is a separation between bimodal heel counter areas not fastened to the anchor system, and the sole.

In another aspect of the device, the bimodal heel counter is positioned with the hollow hemisphere form in the convex position above a rear sole area base, said base comprising a flattened, horizontal bank or ridge, running the perimeter in curved fashion of the rear sole area below the end user's heel to the rear and sloping ends on the sides. The sloped sides mirror the circular lip of the hollow hemisphere above when in convex position, with a raised elevation at the rear of approximately one third that of the radius of the hollow hemisphere element, or less should the heel portion of the sole of an article of footwear have a built in depression, gradually diminishing in height from rear to forward, until flush with the sole, providing a complementing base of similar size as the circumferential lip of the hemispherical portion of the heel counter while in a convex position, and an enveloping supportive base to the hollow hemispherical portion of the heel counter while in a concave position. The complementing base is formed as part of the insole, midsole, outsole or sole, or can manufactured individually, or molded as one piece along with the bimodal heel counter, if installed as a stand-alone element. A flat, transversal ledge may be included at the rear of the base structure, spanning the rear third portion of the circumference of the base, with a thickness less than the base itself, located at a the midpoint vertical point or higher within the base, as to leave an empty space underneath said transversal ledge.

In another aspect of the device, small protruding added supports that are half-cylinders of the approximate height, or higher, of the combined sole and rear base elevation, are located on either side of the area behind the back heel, or added to a separate base element, that contact outer portions of the circumference lip of the hollow hemisphere at the "10 and 2 o'clock" positions of the lip of the hemisphere if viewed from the above, with 12 at the most rearward position.

Within the scope of the present teachings, dependent fastening elements, sized to maximize their utility to secure or release a foot in a shoe, and dependent on the changes in form and position of the bimodal heel counter, are described herein with various embodiments, being fastened to portions of the bimodal heel counter, upper or sole, or are formed during manufacture as one piece along with elements of the bimodal heel counter.

In one embodiment of a dependent fastening element, the apex of the hollow hemisphere form of the bimodal heel counter is connected, using as grommet, snap, other mechanism, or formed as a part, to the front area of the shoe collar of the upper by a looping circular strap, defining a foot-receiving space, which is made of a material of sufficient strength and pliability as to move in conjunction with the hollow hemisphere, subsequently referred herein as a "shoe collar strap." The shoe collar strap is sized in length as the typical measurement of the end user's foot from the rear apex of the lower heel, circling to the forward top of the hindfoot, the region below the element also known as the upper bridge of a shoe, and circling back down the opposite side. The size of the foot receiving space as represented by the shoe collar strap may be modified by a break in the strap at the side of the ankle, and the inclusion of a buckle at one terminating end, and spaced holes at the other terminating end, or other industry standard means for increasing or decreasing the size of a strap, such as loop and hook material added to each terminating end at the break. The shoe collar strap is made of a material of sufficient stiffness as to be pushed up in conjunction with the upper when the hollow hemisphere is in the convex position, and be pulled down and into the cavity formed by the hemisphere being in the concave position. Other layering material, that is of a typical shore hardness of 30 or less, is added to the lower non-covered top convex face of the bimodal heel counter as to form a cushioning area similar and of the same thickness as the shoe collar strap or the insert. Similar soft material is added to the upper non covered top convex face of the bimodal heel counter as to form a cushioning area for the Achilles tendon of the foot, comprising portions of the mustache or heel notch section of a footwear device.

In another embodiment of a dependent fastening element, the shoe collar strap may be connected to a shoe collar strap tab, formed as part of the hollow hemisphere, comprising a curved, flatted rectangular shape, oppositely mirroring the curve of the hollow hemisphere. The shoe collar strap tab is sized of approximately 2-4 mm thickness depending on the material of construction, with a width representing a face of sufficient size as to glue or fasten the shoe collar strap. The shoe collar strap tab may be centrally placed in an indented trough in the face of the hollow hemisphere, said trough of similar length, width and depth as the tab, with a shared contact point between the apex of the curve of the tab and hemisphere form. The strap and trough may be located on the medial line of the forward face of the hollow hemisphere form, near the 130 degree angle when view in convex position from the side.

In another embodiment of a dependent fastening element, the shoe collar strap is connected to the shoe upper covering the bridge of the foot, leading to a front foot strap, similar but not restricted to a transversal band as found in slides, or a buckle or strap similar but not restricted to as found with sandals, or toe loop or toe notch similar but not restricted to as found with flip flops, or a closed-toe front similar but not restricted to as found with sneakers, that secures the front portion of the foot to the greater shoe.

In another embodiment of a dependent fastening element, the heel tab portion of the bimodal heel counter is secured to the rearward face of the back of the sole below the heel with a single strap, belt, string, chain, or other fastening device.

In another embodiment of a dependent fastening element, the heel tab portion of the bimodal heel counter is secured to the rearward face of the back of the sole below the heel with dual straps or similar connective material to the two opposite lateral sides of the rearward face of the back of the sole.

In another embodiment of a dependent fastening element, the rear, uppermost portion of the lip of the hollow hemisphere form when in concave form, directly below the adjoining back heel tab, is fastened with a single strap connected to the rearward face of the back of the sole below the heel.

In another embodiment of a dependent fastening element, the rear, uppermost portion of the lip of the hollow hemisphere form when in concave form, directly below the adjoining back heel tab, is fastened to the two opposite lateral sides of the rearward face of the back of the sole below the heel with dual straps.

In another embodiment of a dependent fastening element, the rear, uppermost portion of the lip of the hollow hemisphere form when in concave form, directly below the adjoining back heel tab, is fastened to the sole with a thin cloth, mesh, EVA, or other material so as to wrap the side and rear areas comprising the heel cap, backstay, and or heel counter, as to form a solid wall fastened or glued to the rearward face of the back of the sole below the heel, and to approximately the top half of the outer edge of the circumferential lip of the hollow hemisphere form while in concave form.

In the embodiments as described in lines 49-53, the referenced dependent fastening devices of a single rear heel strap, double rear heel strap, or solid wrap of flexible cloth-like material, as a general mechanical utility are referred to herein as a "rear heel strap." The rear heel strap is affixed during assembly to the bimodal heel counter while inverted in concave form, with the convex form being the native manufactured form. The rear heel strap is sized similar in vertical height to the vertical size of the hemisphere in concave form, with its base resting on the rear sole, and fastened to such, as to prevent the upward movement of the hollow hemisphere away from the sole when pulled by the shoe collar strap with the rising midfoot during walking, running, or other use of the article of footwear.

In another embodiment of a dependent fastening element, dual side heel straps made of a flexible material such as EVA, rubber, spandex or similar elastics are connected to the bimodal heel counter and rear side areas of the sole such that the distance between these two connection points is generally equal when the bimodal heel counter is in both the convex and concave positions, creating a secondary bimodal structure in which the side straps are bimodally stable, and with stored tension, in the two stable positions of the hollow hemisphere, being the morphed convex and concave positions, and are bimodally unstable in the same unstable positions as the hollow hemisphere. The dual side straps may be in the form of a single loop connected at the rear side areas of the sole, with its midpoint affixed to the bimodal heel counter. The dual side straps may also be in the form of a thin cloth, mesh, EVA, or other material as referenced in paragraph 53, so as to wrap the side and rear areas comprising the heel cap, backstay, and or heel counter, thereby fulfilling the utilities of both the dual side heel straps and rear heel strap in one single fastening element.

In another embodiment of a dependent fastening element, the dual side straps, or single loop, one strap connected to the sole on both sides, or flexible side wall elements that provide the same mechanical utility, connect the sole to the heel tab or the secondary heel tab, at the heel notch section. The heel notch section may also be formed as a single element along with the heel tab, or the heel notch section formed as a single element along with the secondary heel tab. The side straps, or similar structures of the same utility as referenced in this paragraph, are made of a material as to gain and release potential energy as the hemisphere section morphs from the convex to the concave stable positions and vice versa.

In another embodiment of a dependent fastening element, the heel notch section of a footwear device is fastened to the back heel tab, when the bimodal heel counter is in its concave position using a grommet, snap or other mechanism.

In another embodiment of a dependent fastening element, the heel notch and back heel tab are formed together as one piece in an alternative manufacturing process.

In another embodiment of a dependent fastening element, the heel notch section of a footwear device is fastened to the secondary heel tab, when the bimodal heel counter is in its concave position using a grommet, snap or other mechanism.

In another embodiment of a dependent fastening element, the heel notch and secondary heel tab are formed together as one piece in an alternative manufacturing process.

In another embodiment of a dependent fastening element, the heel notch and secondary heel tab and side straps connecting to the sides of the shoe at the sole are formed together as one piece in an alternative manufacturing process.

In another embodiment of a dependent fastening element, the heel tab is formed together as one piece along with a forefoot strap, forming a heel notch, said forefoot strap defined as two flexible bands extending directly from the heel notch/heel tab piece, attaching to the forefront section of an article of footwear such as the front toe box, or: pass through forefoot strap vector changing loops located at the sides of the shoe at the sole; or pass through forefoot strap vector changing loops located at the front of the shoe at the sole; or pass through a single forefoot strap vector changing loop located at the front of the shoe above the toe box or tongue, with the forefoot strap continuing back up to the front middle section of the shoe collar above the tongue.

In one or more embodiments of the article of footwear, dual side straps are connected to the front collar portion of the upper after passing through dual vector changing devices such as a loop, buckle, hole, or wheel located at the sides of the sole or in the side walls. In this embodiment, the structure comprising the front shoe collar, bridge and or tongue is constructed as in its native form is bent slightly up and away from the hindfoot.

In one or more embodiments of the article of footwear, the dual side straps are connected to the front collar portion of the upper after passing through a vector changing device such as a loop, buckle, hole, or wheel located at the front of the shoe, either in dual locations to the sides of the vamp, or joined in a single location at the top of the vamp, toe box, or tongue. In this embodiment, the structure comprising the front collar portion is constructed with flexible material such as to permit movement up and away from the hindfoot.

In one or more embodiments of the article of footwear, the side straps are connected to the front collar portion of the upper after passing through a vector changing device such as a loop, buckle, hole, or wheel located at the front of the shoe, either in dual locations to the sides of the vamp, or joined in a single location at the top of the vamp, toe box, or tongue. In this embodiment, the structure comprising the front collar portion is constructed with flexible material such as to permit movement up and away from the hindfoot.

In another embodiment of a dependent fastening element, the bimodal heel counter is connected with a shoe collar band directly to the front area strap, in which the shoe collar strap bridges the hemisphere apex directly to the toe securing strap.

In another embodiment of a dependent fastening element, the bimodal heel counter is connected with a forefoot strap directly to the front area strap, in which the forefoot strap bridges the heel tab or heel notch directly to the front foot securing element, toe securing strap or toe thong.

In another embodiment of a dependent fastening element, the forefoot strap(s) pass through a vector changing device such as loops, buckles, pulleys, wheels, gaps, holes, pivot pins, or other similar mechanisms, and connect the heel tab to the toe securing strap. The vector changing device(s) is located at the rear of the sole adjacent to the heel on both sides, or at a point to create equilateral distance from the heel tab pivot point, or can be located in a single front portion of the upper.

In another embodiment of a dependent fastening element, the bimodal heel counter heel tab is connected with straps, strings, ropes, elastic, belts, bands, or similar to the upper after passing through a vector changing, pivoting "S" system with a central axis, located on the side walls of the shoe device.

In another embodiment of a dependent fastening element, a vector changing, pivoting pin joint system operating with torsion springs, located on the on the side walls of the shoe device, connects the bimodal heel counter heel tab via straps, strings, ropes, elastic, belts, bands, or similar to the upper or front area strap.

In another aspect of a dependent fastening element, an insole is sized as to permit the entire rear heel holding section to fit within the cavity of the inverted hollow hemisphere form of the bimodal heel counter in concave position, and centrally affixed to the apex of the hollow hemisphere form. The rear sides of this insert, adjacent the where the heel will be when worn by the user, are affixed to a shoe collar band(s) which extend up and over the hindfoot, or to a similar shoe element of the same function. The insert is glued or affixed from a point forward of the bimodal heel counter at the approximate front-to-back midpoint of the sole, and not glued or affixed directly to the front of the bimodal heel counter.

In one or more embodiments of the article of footwear, the bimodal heel counter is formed in one piece along with the sole, midsole, outsole or insole.

In another aspect of the device, the bimodal heel counter is formed in one piece along with all or some elements that comprise the function of the dependent fastening elements as discussed in the present teachings.

In one or more embodiments of the article of footwear, the anchor of the bimodal heel counter is partially recessed into the sole. The anchor may comprise on or several shapes such as a rectangular prism, cube, cylinder, cone or other form that can function in similar mechanical fashion, connected in vertical format to the forward side of the horizontal plane of the circumferential lip, that is inserted, glued or otherwise fastened into a complementing punched out void(s).

In another aspect of the device, the front foot area strap is connected to the sole.

Referring to the drawings, wherein like reference numbers refer to like components, FIGS. 1-4 shows a basic device 100 apt to be installed in a bimodal article of footwear. FIGS. 5-11 define elements of 100 for functionality, including: complementary base 131, a transversal ledge 133, partial cylindrical supports 136, secondary back heel tab 137, shoe collar strap tab 138, and shoe collar strap tab trough 139. FIGS. 12-23 define dependent fastening elements in various embodiments of an article of footwear including side heel straps 110, rear heel strap 120, shoe collar strap 117, vector changing loop(s) 130, and forefoot strap 141.

Figure 2:
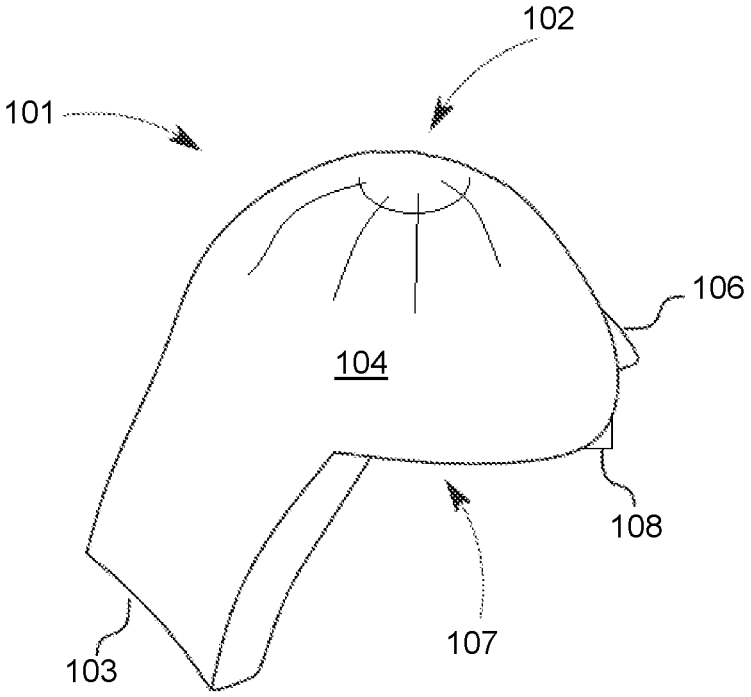
FIG. 2 is a schematic illustration in rear perspective view of the device of FIG. 1.
Figure 3:
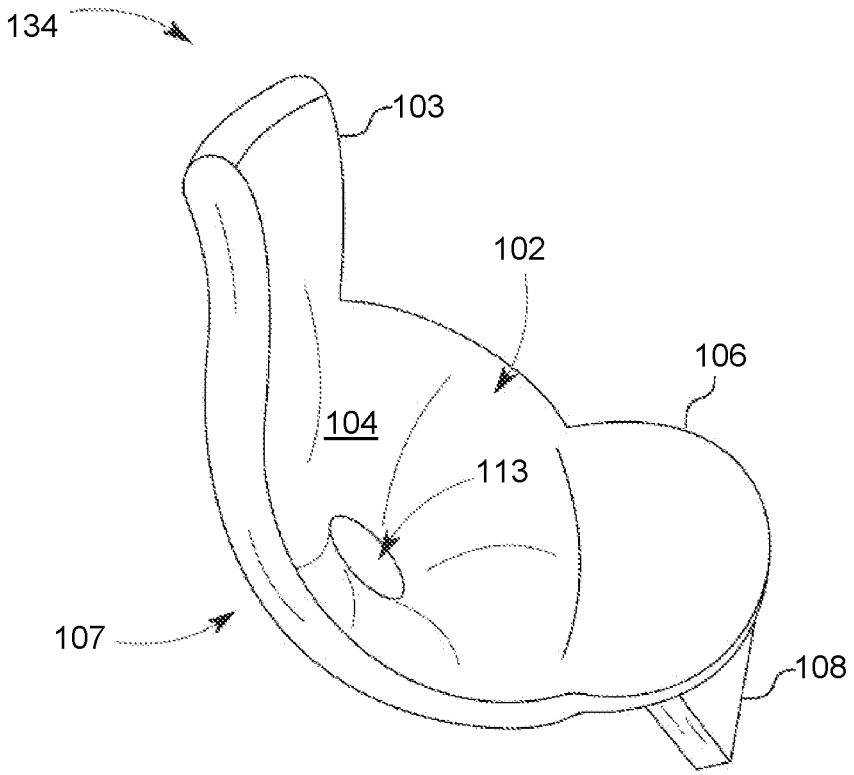
FIG. 3 is a schematic illustration in perspective view of the device of FIG. 1 in a stable, concave position.
Figure 4:
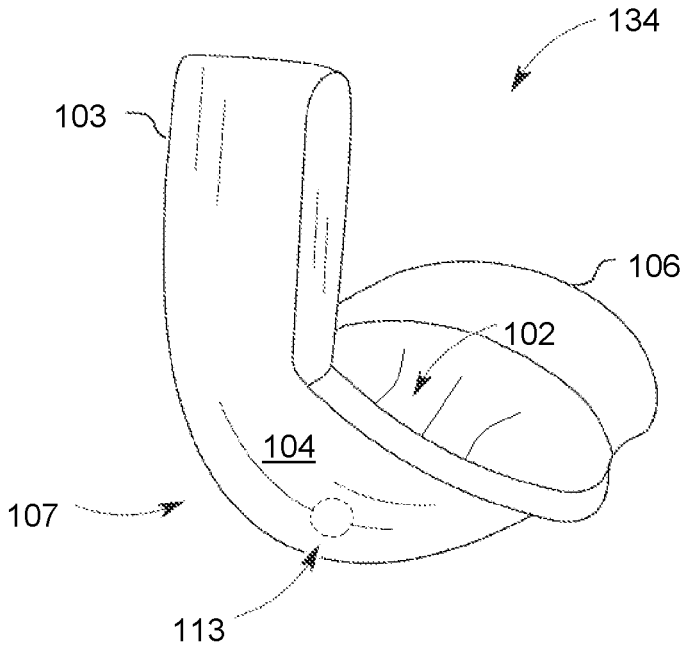
FIG. 4 is a schematic illustration in rear perspective view of the device of FIG. 1 in a stable, concave position.

As seen in FIGS. 1-4, the device 100 includes a hollow hemisphere solid form 104, as defined by the solid form between dual concentric hemispheres 102 and 107 that share the same circumferential plane. The hollow hemisphere 104 is configured to selectively snap between a convex position 101, as seen in FIGS. 1-2, and a second concave position 134 as seen in FIGS. 3-4, with a hemispherical face 102 and an opposite hemispherical face 107 as seen in FIGS. 1-4. A back heel tab 103 extends from the circumferential lip face of form 104 in a general downward direction while in convex position as seen in FIGS. 1-2, and in a vertical upward position while in concave position as seen in in FIGS. 3-4. The hemisphere form 104 is connected to an anchor element 105, which may comprise a horizontal tab 106 apt for securing to a sole, a vertical tab 108 about for embedding in a sole, or to both, or the anchor is formed as a portion of a sole.

The device 100 is sized as to form a horizontal upwards sitting dome with face 102 in convex position 101 apt for a heel to contact. Similarly, the device is sized as to form a vertical dome, with a forward facing hollow cavity, with the hemisphere in concave position 134 apt for the apex 113 of the hemisphere form to contact the a sole layer below. The device 100 can be a single manufactured component, added during manufacture to existing footwear components, or is molded as one piece with other elements of a footwear device. This device 100 is subsequently referred to as a "bimodal heel counter."

The bimodal heel counter is constructed of nonrigid, elastic material with shore hardness, tear strength, and elongation as to be configured to selectively snap to a first and second stable positions, wherein the bimodal heel counter has convex position 101 and concave position 134, one in its manufactured state and one caused by the shoe user, either or both positions with stored kinetic potential e.g. elastic potential energy. The bimodal heel counter can be changed from one position to the other by directional force from multiple sides e.g. lateral forces directed to a pressure point.

When directional force is applied, for example with the heel, to a pressure point near the apex 113 of face 102 of hollow hemisphere form 104 while in convex form 101, with the circumference lip pressing against the sole 111 and base 131 causing the top center to bend downward and inward, causing a transverse displacement of a central portion of the hollow hemisphere form 104 relative to its lip, a point is reached at which the concavely circular stress to the circumferential inner region of hemisphere face 102 becomes greater that the convex circular rigidity of the material of the outer circumferential lip of hemisphere face 107, causing the entire hollow hemisphere form to morph to concave shape 134. The hemisphere's lip changes from a downward plane to a generally vertical position due to the front being anchored to the sole; the heel tab is likewise pushed upwards into a vertical position, forming a shape backing the rear Achilles area of the heel.

When directional force is applied, for example with the toe or heel of the opposite foot, to the top of the heel tab 103 of hollow hemisphere form 104 in a concave position 134, in a general rearward and down movement, in conjunction with apex 113 of face 107 contacting a sole or base below, the tab acts as a lever pulling downward the topmost lip of the hollow hemisphere form 104, which subsequently pulls the rest of the circumferential lip in like fashion, finally causing the entire hollow hemisphere form to morph to convex shape 101.

Figure 5:
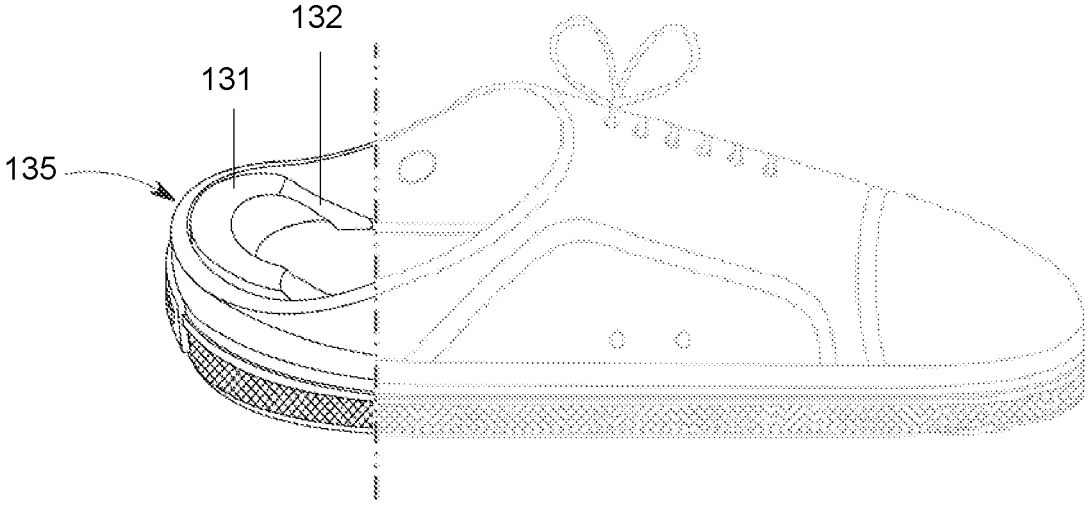
FIG. 5 is a schematic illustration in perspective view of a back sole base at the heel in an embodiment of an article of footwear.
Figure 6:
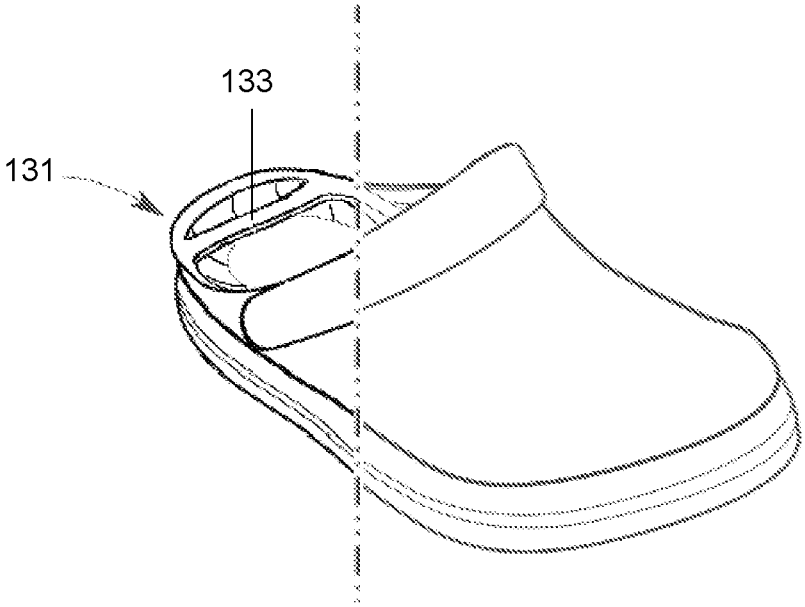
FIG. 6 is a schematic illustration in perspective view of a back sole base including a flexible transversal ledge at heel in an embodiment of an article of footwear.

As seen in FIGS. 5 and 6, (which do not show the bimodal heel counter for clarity), the bimodal functionality of the heel counter is enhanced with a complementary base 135, of at least one third the circumference of the hollow hemisphere, being a raised curved ledge, flattened to the rear and ramping down on the sides to the sole, with similar curvature, width and size of the hollow hemisphere. The base is positioned or forms part of a rear heel sole area 131. The complementary base, either a stand-alone piece, or forming part of the bimodal heel counter, or formed as part of the sole, is constructed to form a generally horizontal flat rim at the rear heel area, surrounding a concave heel base at the area directly below where the heel will rest when housed in the concave hollow hemisphere form 104. In some cases, the rim 131 decreases at a slight angle with respect to the horizontal sole, with the rearward portion higher than the forward portion, causing a slight slope 132 beginning from the rearward portion of the sole and ending at the region located at the anchor 105, as to be roughly equal in size to the face of the lip of the circumference of the hollow hemisphere form above. Additionally, as seen in FIG. 6 the rearmost portion of the sole comprising the complementary base can constructed to include a transversal ledge 133. The transversal ledge can be of the same material as the rim 131, or can be an add-on piece, for example a 3 mm neoprene strap or similar flexible material stretching from the left and right sides of sole below the ankle, placed as to have the midpoint contact the apex 113 when the hollow hemisphere of the bimodal heel counter 104 is in concave form. The elasticity of the transversal ledge provides stiff vertical resistance to the hollow hemisphere form 104 in concave form when force is being applied to the heel tab, yet is constructed and placed as to be pliable to horizontal forces, constructed of a material and thickness as to enable it to be displaced rearward, pushed to and permit the morphing of the hollow hemisphere such as when the hemisphere is being pressed downward while in the convex position. The complementary base can be formed as part of bimodal heel counter, with lateral connections extending form the anchor back along the rear sides of the heel area, and connecting to the upwardly sloping rim section. In another variation, the base can be formed as part of the sole, midsole, insole, or outsole.

Figure 7:
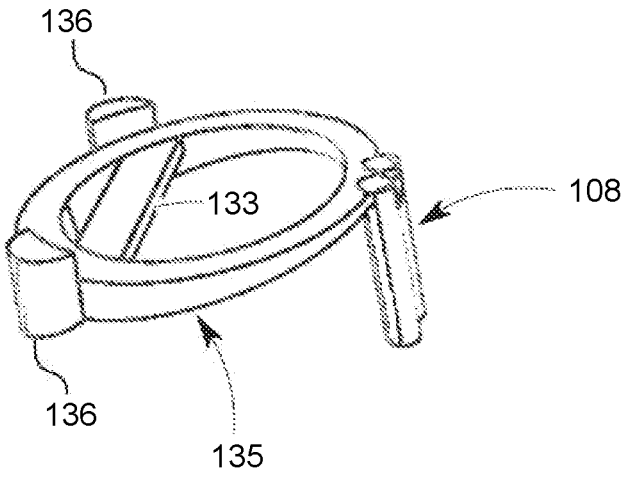
FIG. 7 is a schematic illustration in perspective view of a stand-alone mechanism incorporating the elements of a back sole back of FIG. 5, the flexible transversal ledge of FIG. 6, cylindrical supports, and an alternative vertical anchor.

FIG. 7 illustrates the complementary base 135 when constructed as a stand-alone element, in which the rim areas 131 and 132 combine in one element of consistent slope. The transversal flexible ledge 133 is positioned to the rearward section of approximately the rear one-third of the circumference of the hemisphere. Added partial cylindrical supports 136 are constructed of size and strength as to provide an outward limiting guide upon which the rim of the hollow hemisphere contacts when in expansion as well as restricting the bulging of the circumferential lip of the hemispherical portion of the heel counter while changing from convex to concave position. Anchor 108, and the lower face of base 135 can be fastened to lower sole portions of a footwear device and secured with glue or other means.

Figure 8:
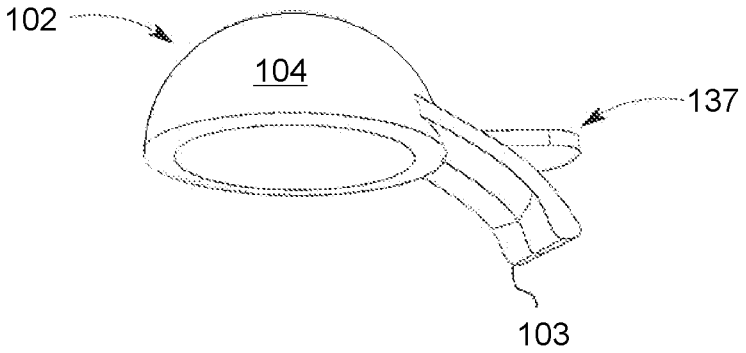
FIG. 8 is a schematic illustration in perspective view of the device of FIG. 1, illustrating an added element of a secondary rear heel tab.

FIG. 8 illustrates the hemisphere of the bimodal heel counter when constructed as a stand-alone element separate from the anchor 108 and complementary base 135. Back heel tab 103 is shown with hollow hemisphere 104 in convex form 102, formed at an angle of 45 degrees relative the horizontal base of hemisphere 104. Secondary back tab 137 projects rearward, at a similar angle as the horizontal base of hemisphere 104.

Figure 9:
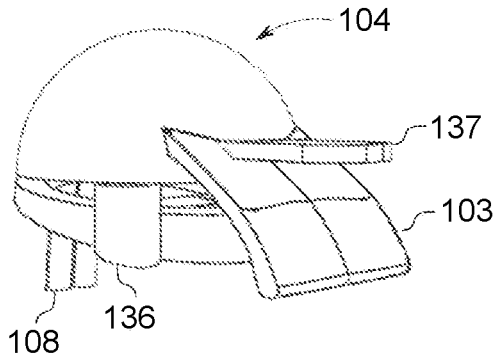
FIG. 9 is a schematic illustration in rear perspective view of a stand-alone mechanism incorporating the devices of FIG. 7 and FIG. 8, representing an alternative embodiment of the device of FIG. 1.
Figure 10:
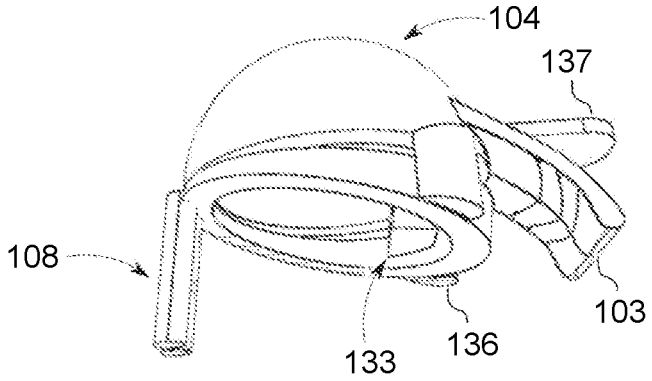
FIG. 10 is a schematic illustration in forward perspective view of the device of FIG. 9.

FIGS. 9-10 illustrate a single molded embodiment of the bimodal heel counter molded as one piece along with the complementary base 135 and anchor 108. In this embodiment, 104 and 135 share anchor 108, and are physically joined at the forwardmost contact point. Cylindrical supports 136 are sized as to permit hemisphere 104 to be pushed down within them.

Figure 11:
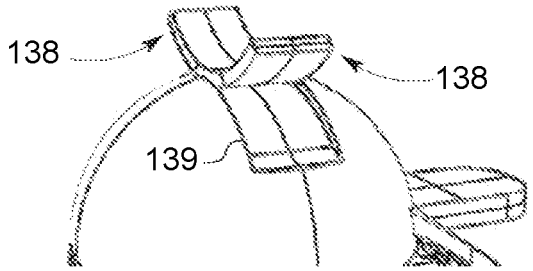
FIG. 11 is a schematic illustration in side perspective view of the device of FIG. 9, with a shoe collar strap tab and shoe collar strap tab trough.

FIG. 11 illustrates a shoe collar strap tab 138, that may be formed as one piece of the bimodal heel counter. Shoe collar strap tab 138 is positioned within a trough 139, an indentation of similar dimensions, being the inverse form of shoe collar strap tab 138. When hollow hemisphere 104 morphs from the convex stable position to the concave form, shoe collar strap tab occupies the indentation of trough 139.

As seen in FIGS. 12-17, an article of footwear 118 includes the bimodal heel counter 100 with complementary base, a sole structure 111 and an upper with dependent fastening elements including side heel straps 110, shoe collar strap 117, rear heel strap 120, along with other non-dependent elements commonly found in shoes such as midfoot upper 115 and a front foot strap 114 at the toe box, connected to the sole 111 at point 121, either via glue, grommet or similar fasteners.

As seen in FIGS. 13, 15-17, in the preferred manufacturing embodiment, side heel straps 110 are secured to the sole at location 112, and fastened to the bimodal heel counter in concave form. The back heel tab 103 is fastened to flexible side straps 110 at securing point 119. These lateral side straps is made of a material as to gain and release potential energy as the hemisphere section morphs from the convex to the concave stable positions and vice versa. The placement of the attachment is from the connection point of the back heel tab to the secondary heel tab is sized to approximate in length the difference in distance between the pivot point of the hollow hemisphere form at its anchor, and the point of connection of the side straps to the sole on either side. The straps 110 are sized as to be in its native form the distance between connection point 112 and the lower Achilles region of the heel and fleshy area above the rear calcaneus, such that when the hollow hemisphere 104 is reverted back to convex form, the straps at point 119 are pulled back with significant tensile pull towards the rear of the article of footwear, adding potential energy to the side straps, as best seen in FIG. 14. Point 119 can also be the location of a secondary back heel tab.

Figure 12:
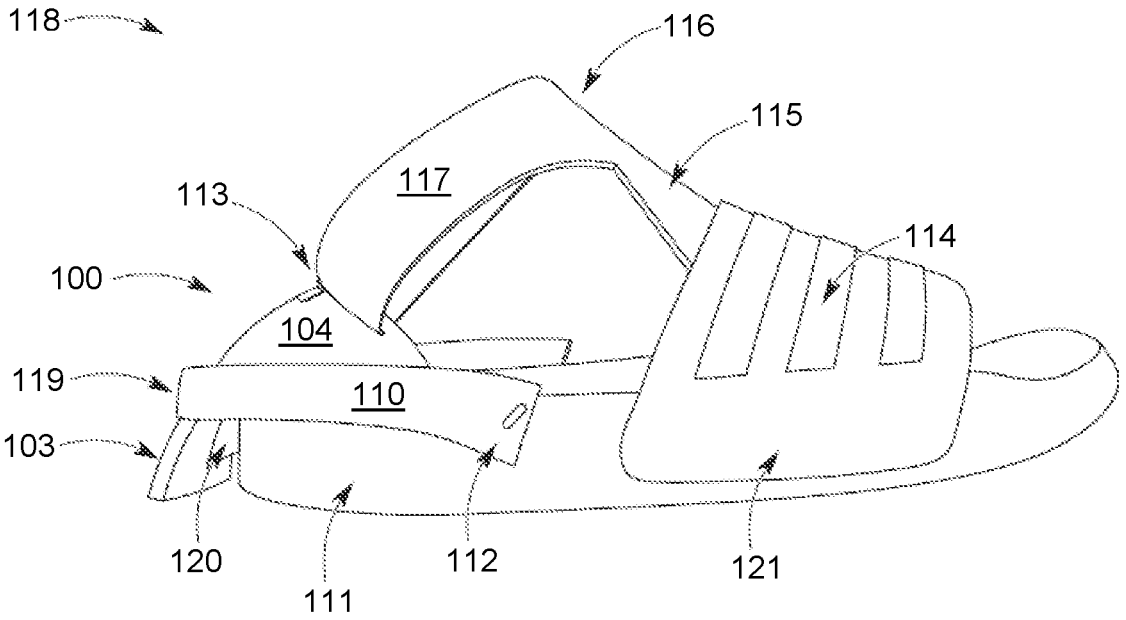
FIG. 12 is a schematic illustration in side view of the embodiment of an article of footwear, with the device of FIG. 1 secured to a sole and dependent fastening elements a sole layer, including side straps, heel collar strap, with the heel counter in the stable convex position.

The shoe collar strap 117, as seen in FIGS. 12 and 14 while the bimodal heel counter is in convex form, thus defines a foot insertion cavity, that is raised by approximately twenty degrees higher than when the bimodal heel counter is in concave position, as measured from the horizontal sole, providing a better angle for the foot to be inserted by a standing or sitting person. The shoe collar strap 117 is fastened to the bimodal heel counter near or just forward of the apex 113, on the front face of hollow hemisphere 104. The shoe collar strap is sized as to the typical circular measurement of a foot from the base of the heel to the hindfoot and back around. The strap is constructed of a thin band of less flexibility such as neoprene with a low rubber content, EVA of a higher shore hardness, nylon strap, or similar. The strap is of sufficient strength as to maintain elevated the bridge 115 at contact point 116, and of sufficient elasticity as to maintain a form in the shape of a circle or ellipsoid insertion cavity apt for receiving a foot.

Figure 13:
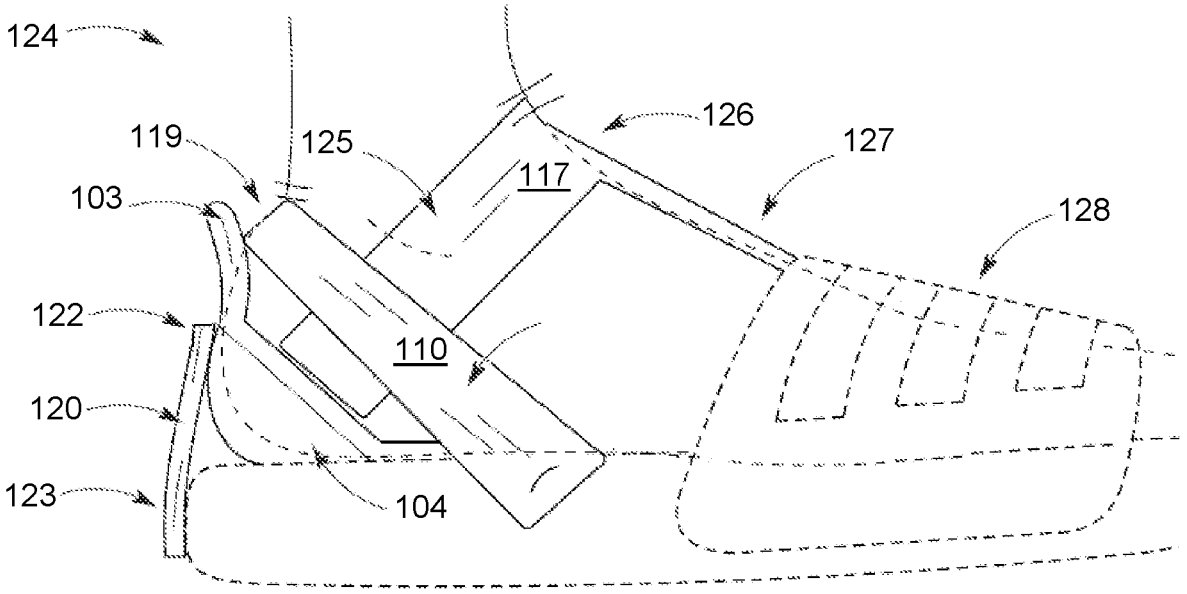
FIG. 13 is a schematic illustration in fragmentary side view of article of footwear of FIG. 12, with the heel counter in the stable convex position, showing the inserted foot.
Figure 14:
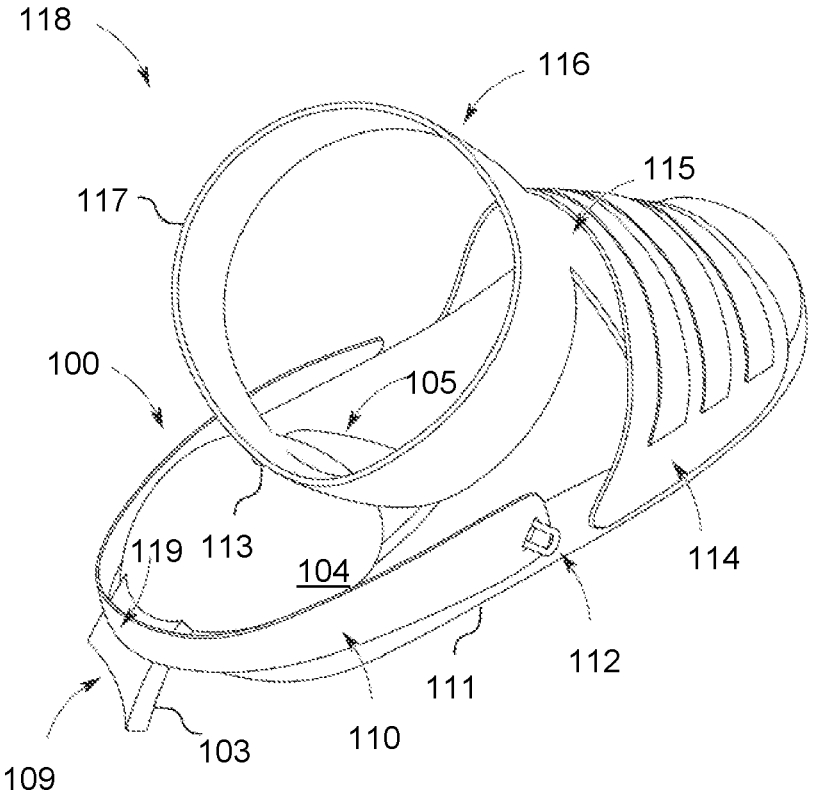
FIG. 14 is a schematic illustration in rear perspective view of the embodiment of an article of footwear of FIG. 12, with the heel counter in the convex position.
Figure 15:
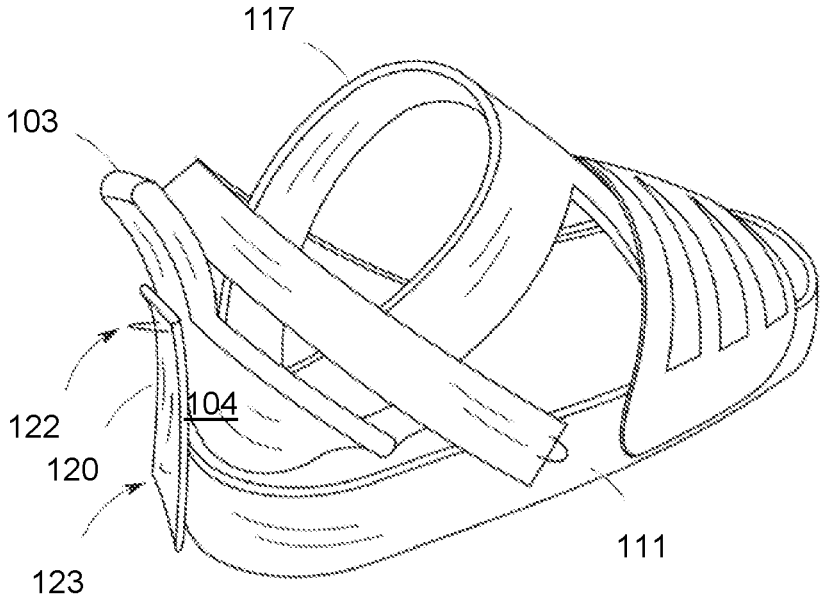
FIG. 15 is a schematic illustration in rear perspective view of the embodiment of an article of footwear of FIG. 12, with the heel counter in the concave position.
Figure 16:
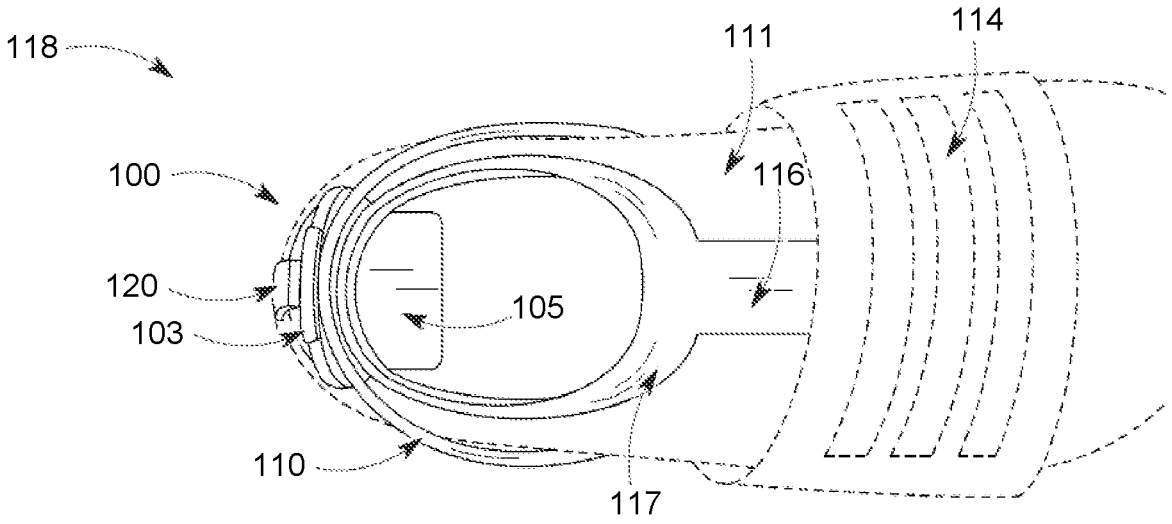
FIG. 16 is a schematic illustration in plan fragmentary view of the embodiment of an article of footwear of FIG. 12, with the heel counter in the concave position.
Figure 17:
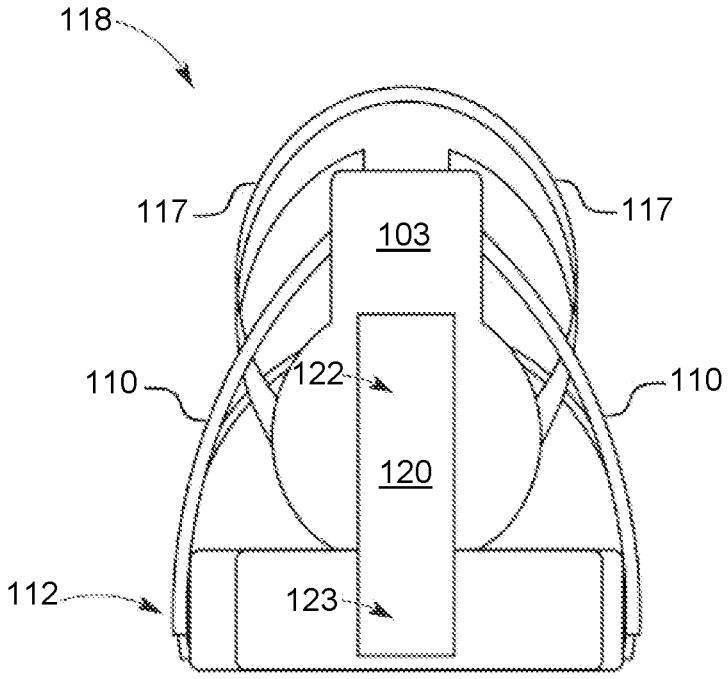
FIG. 17 is a schematic illustration in rear orthogonal view of the embodiment of an article of footwear of FIG. 12, with the heel counter in the concave position.

As seen in FIGS. 13, 15, 17 a rear heel strap 120 is secured at point 123 to the back face of the rear sole, and at point 122 to the top portion of the hollow hemisphere form 104, or the top portion of the rear lip of hollow hemisphere 104 in concave form. In the preferred method of manufacture, form 104 is converted to concave form manually or mechanically, then pulled down until form 104 is nestled in the complementary base 131, and then fastened to the back sole are with rear heel strap 120.

As best seen in FIGS. 12, 13, a foot 124 can be inserted into the foot insertion cavity as formed by strap 117, until the toes are secured in the front foot strap 114, and the strap 117 fully contacts the fleshy upper regions of front portion of the hindfoot, or, rear top midfoot area at point 126. The downward pressure of the heel of the foot morphs the bimodal heel counter from its convex position as seen in FIGS. 12 and 14, into a concave position as seen in FIGS. 13, 15-17, causing the insertion cavity of the shoe formed by the shoe collar strap to lower, the hemisphere 104 to envelope the heel as a heel counter, both securing a foot in the shoe. Simultaneously, causing the bimodal heel counter to snap into the concave position causing the rear heel tab 103 and or secondary extended tab, to rise up to a vertical position, causing the side heel straps 110 at connection point 119 to tighten and be pulled up and over the back heel of the foot at the heel notch.

As seen in FIG. 13, 15-17 while the heel counter is in concave position, to remove the foot 124 from the shoe device 118, the vertical rear heel tab 103 is pushed downward by the opposite toe, hand or heel, acting as a lever pulling down the top region of form 104, causing the bimodal heel counter 100 to snap into the convex position 101, causing the opening of the shoe formed by the shoe collar strap 117 to rise up permitting the foot be removed and also providing a suitable space for future foot insertion in the shoe. Simultaneously, causing the bimodal heel counter to snap into the convex position 101 causes the side heel straps 110 connected to tab 103 at point 119 to be pulled back and down over the back heel, away from the Achilles region of the heel, permitting the foot be removed and also maintaining the side straps 110 in a pulled back position, providing a suitable space for a heel to be placed above the convex hemisphere 104 for future foot insertion in the shoe.

As seen in FIGS. 13, 15-17, during walking or running with the article of footwear 118, the material of tongue bridge 115 at point 126 is made of sufficiently stiff or elastic material as to pull up the shoe collar strap 117, which is also made of sufficiently stiff or elastic material as to apply securing pressure to areas of the foot at point 125, thereby pulling up the hollow hemisphere 104 through fastening point 113, which in turn pulls up the rear heel strap at point 122, thereby pulling up the rear of sole 111 at point 123, and permitting the shoe to follow the changing form of the flexible foot during motion. During the same lifting motion of a natural gait, the fleshy region above the calcaneus pulls upwards on the side straps 110 at point 119, which is also made of sufficiently stiff or elastic material as to pull up the sole at connection point 112, further permitting the shoe to follow the changing form of the flexible foot during motion.

As seen in FIGS. 18-23, various combinations of dependent fasteners, heretofore disclosed including side heel straps 110, shoe collar strap 117, and rear heel strap 120, as well as additional dependent fasteners disclosed herein including a forefoot strap 141, and vector changing loops 130, work in conjunction with the bimodal heel counter in alternative articles of footwear to enhance the ease of foot entry and removal, allowing hands free foot entry into and removal from an article of footwear.

Figure 18:
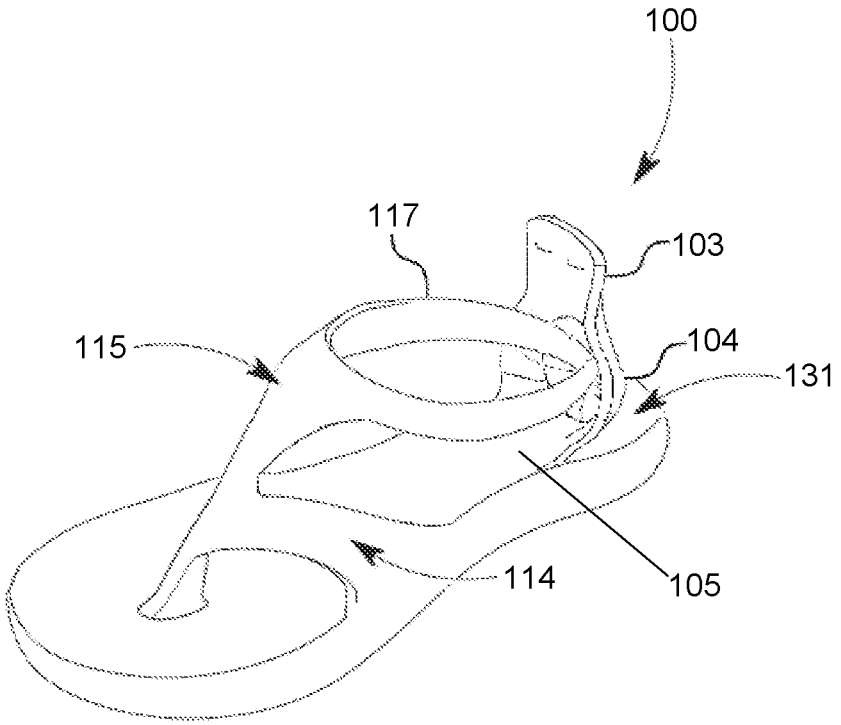
FIG. 18 is a schematic illustration in perspective view of an alternative embodiment of an article of footwear, with the device of FIG. 1 manufactured as part of or secured to a sole layer, and other related elements including a shoe collar strap connected to the heel tab formed as one piece along with the heel notch, a forefoot upper, toe thong, with the heel counter in the concave position.
Figure 19:
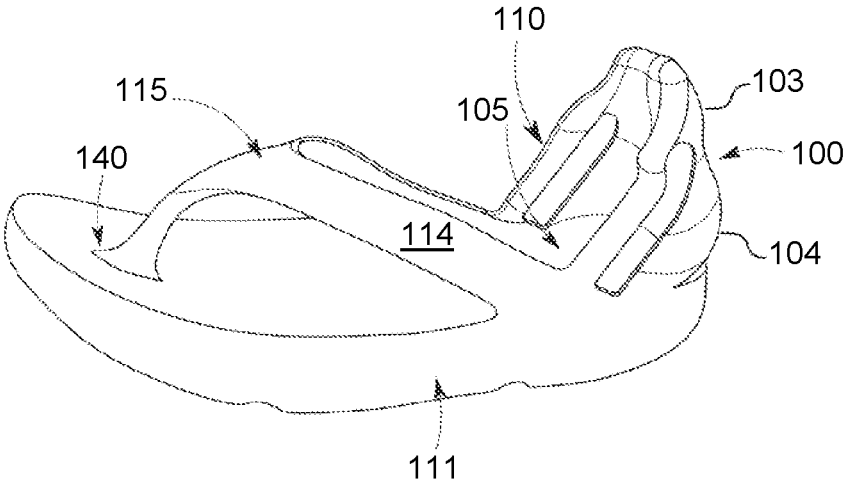
FIG. 19 is a schematic illustration in perspective view of an alternative embodiment of an article of footwear, with the device of FIG. 1 manufactured as part of or secured to a sole layer, and other related elements including a forefoot strap connected to the sole, forefoot upper, toe thong, and a heel tab formed as one piece along with the heel notch and side straps, with the heel counter in the concave position.
Figure 20:
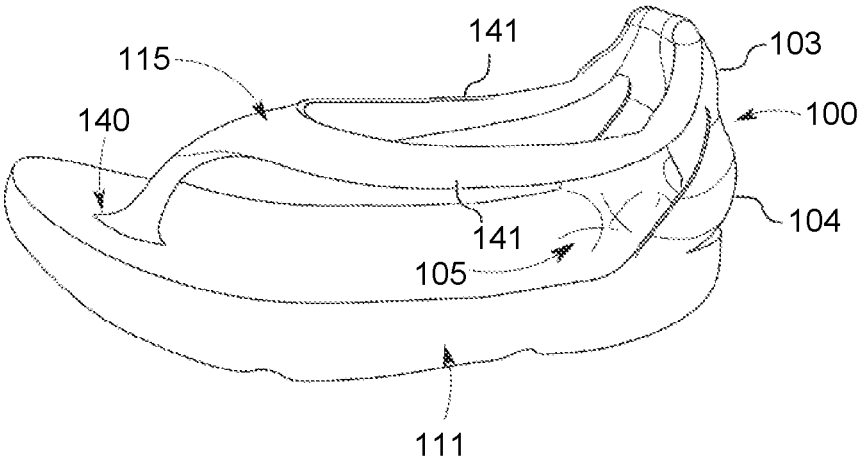
FIG. 20 is a schematic illustration in perspective view of an alternative embodiment of an article of footwear, with the device of FIG. 1 manufactured as part of or secured to a sole layer, and other related elements including a forefoot strap, forefoot upper, and toe thong with the heel counter in the concave position, and without side straps.
Figure 21:
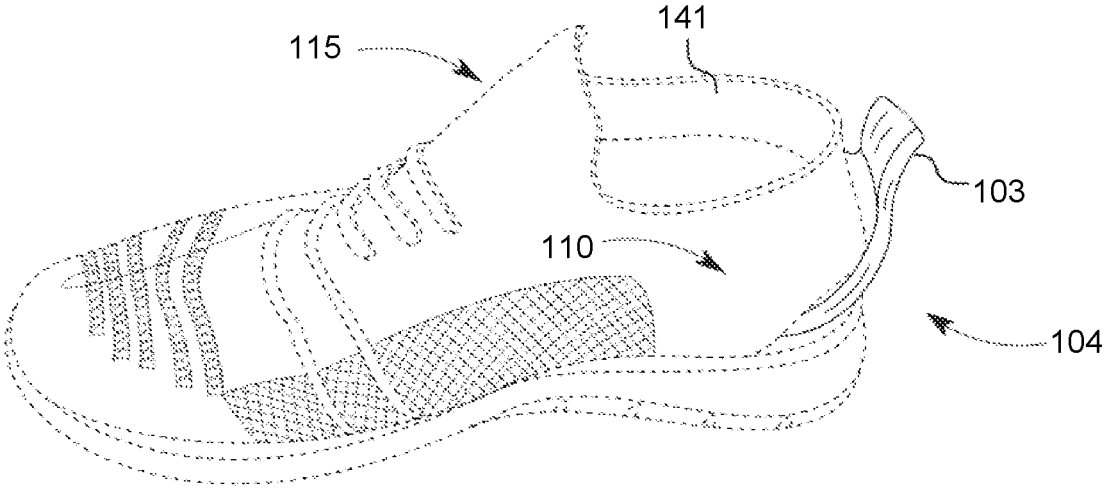
FIG. 21 is a schematic illustration in perspective view of an alternative embodiment of an article of footwear, with the heel counter in the concave position and an upper of flexible materials.
Figure 22:
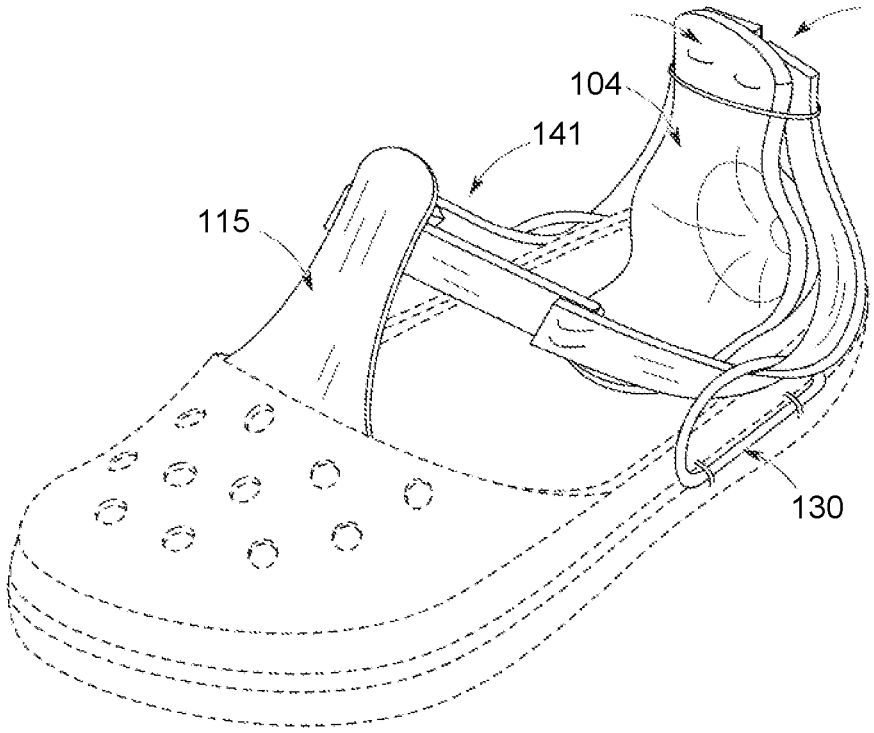
FIG. 22 is a schematic illustration in perspective view of an alternative embodiment of an article of footwear, with the bimodal heel counter in the concave position, with a forefoot strap passing through dual side vector-changing mechanisms and affixed to the rear tab of bimodal heel counter.
Figure 23:
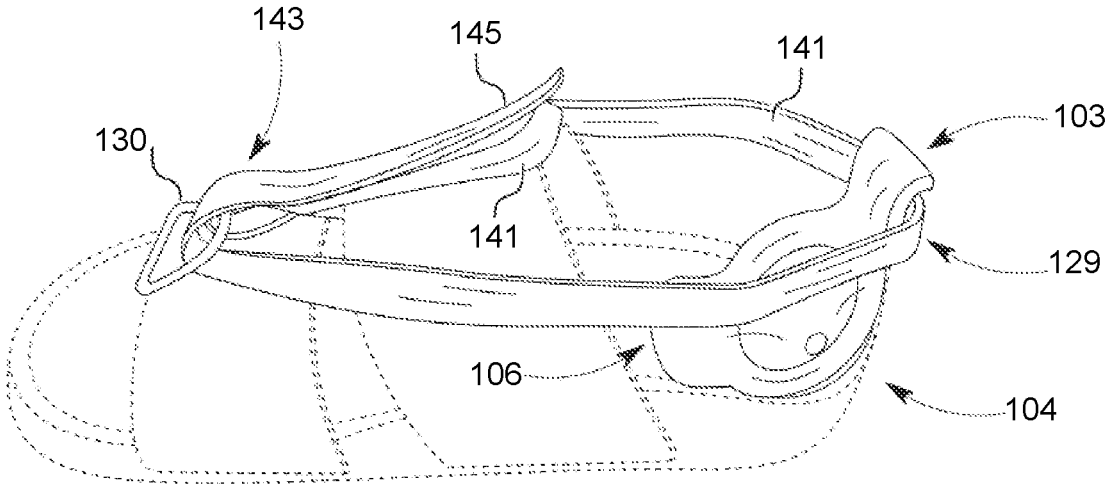
FIG. 23 is a schematic illustration in perspective view of an alternative embodiment of an article of footwear, with the bimodal heel counter in the concave position, with a forefoot strap passing through a vector-changing mechanism affixed to front shoe toe box area, and affixed to the rear tab of bimodal heel counter.

The following six embodiments provide example configurations of alternative embodiments of an article of footwear, comprising a bimodal heel counter 100, dependent fastening elements, a sole, and a footwear upper as disclosed herein:

Embodiment 1. FIG. 18 shows an alternative embodiment of an article of footwear, representing a functional bimodal article of footwear, in which bimodal heel counter 100, shown in concave position, is manufactured as one formed piece, along with shoe collar strap 117, front strap 114, and tongue 115 with toe notch;

Embodiment 2. FIG. 19 shows an alternative embodiment of an article of footwear, representing a functional bimodal article of footwear, in which: the side heel straps 110 and back heel tab 103 are formed in one piece, forming a heel notch; anchor 105 is formed as one piece with sole 111; and containing a simple upper of front straps 114 and a toe thong 140. For example, the article of footwear can be molded in one piece with sphere 104 in convex position using EVA manufacturing, with the side straps originally separated at the bottom end(s), but subsequently attached during the assembly process to sole 111 with the hemisphere being manually converted to a concave position;

Embodiment 3. FIG. 20 shows an alternative embodiment of an article of footwear, representing a functional bimodal article of footwear, in which: the back heel tab 103 forms a heel notch connected to elongated forefoot straps 141; the anchor 105 is formed as one piece with sole 111; and containing a simple upper of a forefront straps 141 and toe thong 140. For example, the article of footwear can be molded in piece with sphere 104 in convex position and blown using EVA manufacturing, with the forefoot straps 141 subsequently attached to the back heel tab 103 while the hemisphere is in concave position;

Embodiment 4. FIG. 21 shows an alternative embodiment of an article of footwear, representing a functional bimodal article of footwear, in which the side heel straps 110 and forefoot straps 141 are formed of flexible fabric such as cloth, spandex based cloth, stretch nylon fabric, rubber based cloth, or similar is incorporated in the wall and upper of the footwear. For example, in this embodiment the bimodal heel counter 100 can be anchored in the midsole, with the rear heel portion of an insert located above the anchor and resting above the hemisphere 104 in convex position, and occupying the heel counter base when hemisphere 104 is in the concave position;

Embodiment 5. FIG. 22 shows an alternative embodiment of an article of footwear, representing a functional bimodal article of footwear, in which the forefoot straps 141 are fastened to the rear heel tab 103 at point 129, pass through vector changing loops, or similar devices of the same mechanical properties, positioned at the lower side walls or sides of the sole, and finally are connected to the front shoe collar area above the upper tongue area 115. The loops are positioned closer to the rear of the shoe than the front, and the forefoot straps 141 are sized such that, the top of the rear heel tab is closer to the vector changing loops when the hemisphere 104 is in a convex position, and is distanced farther to the vector changing loops when the hemisphere is in a concave position. The upper tongue area 115 can be manufactured as to have a native position of a general vertical angle relative to the sole, thereby upon assembly and fastening to concave hemisphere 104 with straps 141 under tension, tongue area 115 is pulled back towards the rear of the shoe, further increasing stored kinetic tension, exhibiting a smaller insertion cavity, and thereby securing a foot. In other words, the forefoot straps 141 create a downward and rearward pulling force to upper tongue area 115 when the hemisphere is in a concave position, with this same pulling force being released when the hemisphere 104 is in a convex position, with 115 and 141 sized as to create a larger foot insertion cavity with this convex position of the bimodal heel, apt for placing or removing a foot;

Embodiment 6. FIG. 23 shows an alternative embodiment of an article of footwear, representing a functional bimodal article of footwear, in which the forefoot straps 141 are fastened to the rear heel tab 103 at point 129, pass through vector changing loop(s), or similar devices of the same mechanical properties, positioned at the front upper, and finally return up to the front shoe collar area. The loop(s) is/are positioned closer to the front of the shoe than the rear, and the forefoot straps 141 are sized such that, the top of the rear heel tab is closer to the vector changing loops when the hemisphere 104 is in a concave position, and is distanced farther to the vector changing loops when the hemisphere is in a convex position, and the forefoot straps 141 create an upward pulling force to front shoe collar area when the hemisphere is in a convex position, with this same pulling force being released when the hemisphere 104 is in a concave position. The upper front shoe collar area can be manufactured as to have a native position creating a smaller foot insertion cavity to secure a foot, and can be sized as to be pulled upwards towards the front of the shoe by the forefoot straps 141 with the hemisphere in the convex position, exhibiting a larger insertion cavity and releasing a foot.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bimodal heel counter of a footwear device, comprising:

a hollow hemisphere structure of flexible, reversible material, selectively morphing at a pressure point to at least one of a convex and concave positions, with a size as to envelope a footwear device user's lower heel, and wherein the hollow hemisphere structure is of an elastic material able to store tension, and is more stable at convex and concave positions, and is less stable at other intermediate positions;

a heel tab extending from a rear lip of the hemisphere portion in a semi-vertical position when the hemisphere is in a stable position, at the back of the heel and Achilles tendon region of the footwear device;

a rear heel strap of band or bands of flexible material connecting to a rearward back face of a rear sole area of the footwear device;

an anchor system connecting a front portion of the hollow hemisphere to the footwear device.

2. The bimodal heel counter of the footwear device of claim 1, in combination with a footwear sole, wherein a curved, semi-circular base rests at the rear sole area, enveloping a lower portion of the hollow hemisphere structure when in one stable position, and offering a complementary flat ridge to the downward facing lip of the hollow hemisphere structure in another stable position.

3. In the combination as set forth in claim 2, an upper that defines at least a portion of a foot insertion cavity, and wherein a user inserting the foot into the foot insertion cavity above the counter in one position causes downward force from the heel to the dome of the flexible hollow hemisphere structure, striking the base at the sole, morphing the structure to a different stable position, wherein a user applying rearwardly and downward force to the lip of the hollow hemisphere structure while holding portions of the sole and foot insertion cavity forward, thereby immobilizing the anchored forward section of the hollow hemisphere, striking the base at the sole, morphing the structure to a different stable position, wherein with the bimodal heel counter in one stable position, the foot insertion cavity being smaller, securing a foot, with portions of the bimodal heel counter having applied pulling and pushing forces as to change the shape, location or stored tension of dependent fastening elements, wherein with the bimodal heel counter in another stable position, the foot insertion cavity being larger, permitting a foot to be inserted or removed, with portions of the bimodal heel counter having applied pulling and pushing forces as to change the shape, location or stored tension of dependent fastening elements.

4. In the combination as set forth in claim 3, comprising a shoe collar strap, a band of flexible material connecting the upper portion of the hollow hemisphere, extending to and forming the upper's front shoe collar, encircling the hindfoot.

5. In the combination as set forth in claim 3, comprising side heel straps, bands of flexible material beginning at the lower rear side portions of the sole, extending up to the upper front portion of the bimodal heel counter.

6. In the combination as set forth in claim 5 wherein a heel tab of the counter and side heel straps are manufactured as one element, forming a heel notch.

7. In the combination as set forth in claim 5, comprising a shoe collar strap.

8. In the combination as set forth in claim 3, comprising forefoot straps, bands of flexible material connected to the forward portions of an upper at the toe box region, extending to the bimodal heel counter at the upper area of the hollow hemisphere or the heel tab, in the form of dual straps.

9. In the combination as set forth in claim 8, wherein a heel tab and forefoot straps are manufactured as one element, forming a heel notch.

10. In the combination as set forth in claim 8, comprising vector changing loops through which pass the forefoot straps, connecting the heel counter to the upper.

11. The bimodal heel counter of the footwear device of claim 2, wherein nested within a rear portion of the base extends a transversal ledge, comprising a thin band of flexible material elevated from the sole.

12. The bimodal heel counter of claim 2, comprising partial cylindrical supports at the rear of the base, of a height greater than the base.

13. The bimodal heel counter of claim 1, comprising a secondary heel tab.

14. The footwear device of claim 1, comprising side heel straps.

15. The footwear device of claim 1, comprising a shoe collar strap.

16. The footwear device of claim 1, comprising a forefoot strap.

17. The footwear device of claim 1, comprising a shoe collar strap and side heel straps.

18. The footwear device of claim 1, comprising a forefoot strap and side heel straps.

19. The footwear device of claim 18, comprising fastening elements constructed of flexible cloth-like material, integrated into the wall and form of the footwear upper, maintaining the same utility and mechanical function of the dependent fastening elements as when in the form of flexible bands.

* * * * *